United States Patent [19]

Matsushita et al.

[11] Patent Number: 4,824,824

[45] Date of Patent: Apr. 25, 1989

[54] HEAT-SENSITIVE THERMAL TRANSFER RECORDING SHEET AND SYSTEM USING THE SAME

[75] Inventors: Toshihiko Matsushita; Shigetoshi Hiraishi, both of Tokyo; Sadao Morishita, Ushiku, all of Japan

[73] Assignee: Mitsubishi Paper Mills, Ltd., Tokyo, Japan

[21] Appl. No.: 73,742

[22] Filed: Jul. 15, 1987

[30] Foreign Application Priority Data

Jul. 17, 1986 [JP] Japan ..... 61-169192
Jul. 17, 1986 [JP] Japan ..... 61-169193
Jul. 17, 1986 [JP] Japan ..... 61-169194

[51] Int. Cl.[4] ..... B41M 5/18; B41M 5/22

[52] U.S. Cl. ..... 503/204; 427/152; 428/913; 428/914; 503/208; 503/217; 503/226

[58] Field of Search ..... 427/150–152; 503/200, 208, 209, 214, 216, 217, 225, 226, 204; 428/913, 914

[56] References Cited

U.S. PATENT DOCUMENTS 4,703,335 10/1987 Hess ..... 503/204

FOREIGN PATENT DOCUMENTS 59-0135188 8/1984 Japan ..... 503/208
59-0135189 8/1984 Japan ..... 503/208

*Primary Examiner*—Bruce H. Hess
*Attorney, Agent, or Firm*—Cushsman, Darby & Cushman

[57] ABSTRACT

A heat-sensitive thermal transfer recording sheet having a heat-sensitive color-forming layer formed on a front side of a substrate and a thermal transfer layer formed on the back side of the substrate and comprising (a) an aromatic isocyanate compound and (b) an imino compound and (c) a low melting point substance such as wax has a white background and excellent image storability. By adding an electron donating colorless dye and an electron-accepting compound to the thermal transfer layer, the transfer density can be improved.

13 Claims, No Drawings

HEAT-SENSITIVE THERMAL TRANSFER RECORDING SHEET AND SYSTEM USING THE SAME

BACKGROUND OF THE INVENTION

This invention relaetes to a heat-sensitive thermal transfer recording sheet having a white background and excellent image storability.

In recent years, against a heat-sensitive recording method using a heat recording apparatus such as a thermal printer, a thermal facsimile or the like, a thermal transfer recording method has been used practically, since said method has advantages in storability, indelibility and solvent resistance of recorded images. The thermal transfer recording method uses a thermal transfer recording sheet comprising a substrate and a heat-meltable ink layer provided thereon. The ink layer of the thermal transfer recording sheet is superimposed on a plain paper, and the ink of the recording sheet is transferred to the plain paper by using a heat supplied from a thermal head of a thermal facsimile or the like, whereby recording is conducted. The thermal transfer recording in a single color (e.g. a black color) is already used practically.

There is also a heat-sensitive thermal transfer recording sheet which can conduct multiple recording and comprises a substrate, a heat-meltable ink layer provided on one side of the substrate and a heat-sensitive color-forming layer provided on the other side of the substrate. In this recording sheet, the thermal transfer layer has a color because the heat-meltable ink used in the layer is a color dye or pigment, and the color is seen through even at the heat-sensitive color-forming layer side. This is undesirable from the appearance standpoint and makes an image developed on the heat-sensitive colorforming layer difficult to distinguish clearly. Hence, various improvements have been made for heat-sensitive thermal transfer recording sheets.

For example, Japanese Patent Unexamined Publication No. 58-78793 discloses a thermal recording sheet for multiple recording comprising a substrate, a heat-sensitive color-forming layer provided on one side of the substrate and a heat-meltable ink layer provided on the other side of the substrate. However, in order for the color of the heat-meltable ink not to be seen through the substrate at the heat-sensitive colorforming layer side, the substrate is subjected to vapor deposition of a metal previously.

Further, Japanese Patent Unexamined Publication No. 55-126482 discloses a heat-sensitive recording sheet for multiple printing having a heat-sensitive colorforming melt transfer layer containing a combination of a leuco dye and a phenolic compound in place of the colored heat-meltable ink layer.

However, the prior art techniques mentioned above have the following various problems.

According to Japanese Patent Unexamined Publication No. 58-78793, since the metal vapor deposition should be applied to the substrate, one more step is required in the production procedure and thus makes the production cost higher. Further, since the colored heat-meltable ink is used, there is another defect in that a component of the thermal transfer layer is transmitted and contaminates an image receiving sheet which is superimposed on the thermal transfer layer during the storage.

According to Japanese Patent Unexamined Publication No. 55-126482, the phenolic compound is used as a substance which reacts with the leuco dye. However, the phenolic compounds disclosed therein are generally highly reactive and readily bring about a color-forming reaction only by mixing with the leuco dye. Therefore, there is a defect in that there takes place background fogging on the coated side during the coating and drying steps.

On the other hand, some of the present inventors have filed a patent application (U.S. patent application Serial No. 820,305) for a heat-sensitive thermal transfer recording sheet overcoming the defects of the prior art mentioned above and with no background fogging. This heat-sensitive thermal transfer recording sheet comprises a substrate, a heat-sensitive color-forming layer formed on a front side of the substrate and a thermal transfer layer formed on a back side of the substrate, both layers containing an electron donative colorless dye and an electron-accepting compound as color forming components. This recording sheet has various excellent properties such as good appearances, good touch, high developed color density, various kinds of hues, but also has defects in that the image storability is poor, e.g. a heat-sensitive color-forming portion and a transferred portion disappear by the action of a plasticizer or additive contained in a plastic such as polyvinyl chloride when contacted with the plastic, or readily disappear by the contact with a chemical contained in foods and cosmetics, or are readily discolored when exposed to sunlight for a short time.

SUMMARY OF THE INVENTION

This invention provides a heat-sensitive thermal transfer recording sheet having a white background and excellent image storability overcoming the defects of the prior art and a heat-sensitive thermal transfer recording system using said recording sheet.

This invention provides a heat-sensitive thermal transfer recording sheet comprising a substrate, a heat-sensitive color-forming layer formed on a front side of said substrate and a thermal transfer layer formed on a back side of the substrate, characterized in that the thermal transfer layer comprises:

(a) an aromatic isocyanate compound, (b) an imino compound of the formula:

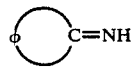

(I)

wherein $\phi$ is an aromatic compound reside which can form a conjugated system with an adjacent C=N and which can form a color by a reaction with said isocyanate compound, and (c) a substance having a low melting point.

This invention also provide a heat-sensitive thermal transfer recording sheet comprising a substrate, a heat-sensitive color-forming layer formed on a front side of said substrate and a thermal transfer layer formed on a back side of the substrate, characterized in that the thermal transfer layer comprises:

(a) an aromatic isocyanate compound, (b) an imino compound of the formula:

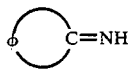

(I)

wherein $\phi$ is an aromatic compound residue which can form a conjugated system with an adjacent C=N and which can form a color by a reaction with said isocyanate compound, (c) a substance having a low melting point, (d) an electron donative colorless dye, and (e) an electron-accepting compound.

This invention further provides a heat-sensitive thermal transfer recording system comprising (A) a heat-sensitive thermal transfer recording sheet comprising a substrate, a heat-sensitive color-forming layer formed on a front side of said substrate, and a thermal transfer layer formed on a back side of the substrate, and (B) an image receiving sheet, characterized in that the thermal transfer layer of the recording sheet (A) comprises:

(a) an aromatic isocyanate compound, or (b) an imino compound of the formula:

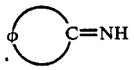

(I)

wherein $\phi$ is an aromatic compound residue which can form a conjugated system with an adjacent C=N and which can form a color by a reaction with said isocyanate compound, and (c) a substance having a low melting point, and if necessary (d) an electron donative colorless dye, or (e) an electron-accepting compound, and the surface layer of the image receiving sheet (B) to be superimposed on said recording sheet comprises:

(b) an imino compound of the formula (I), or (a) an aromatic isocyanate compound, which is one component of the color forming components and reacts with the other component (a) or (b) in the thermal transfer layer, and if necessary (e) an electron-accepting compound, or (d) an electron donative colorless dye, which is one component of the color forming components of another system and reacts with the other component (d) or (e) in the thermal transfer layer.

DESCRIPTION OF THE PREFERRED EMBODIMENTS

In the transfer of the thermal transfer layer to the plain paper, since the aromatic isocyanate compound (a) is reacted with the imino compound of the formula (I) (b) to form one color system, the resulting colored (or color developed) image is remarkably excellent in image storability due to excellent resistance to plasticizer and resistance to light.

Particularly, in this color forming system, a carboxyamide series azomethine colored product is produced by the catalytic reaction of the two components (a) and (b), said colored product being excellent in resistance to light and resistance to chemicals. Further, the hue of the colored product can be changed in a wide range by selecting properly the aromatic isocyanate compounds and the imino compounds properly. For example, there can be obtained black, light brown, brown, red, green and the like colors.

In this color forming system, the aromatic isocyanate is preferably used in an amount of 5 to 25 parts by weight and the imino compound is preferably used in an amount of 5 to 25 parts by weight.

Further, in the transfer of the thermal transfer layer to the plain paper, when two color forming systems are co-used, that is, a color forming system of the electron donative colorless dye (d) and the electronaccepting compound (e), and a color forming system of the aromatic isocyanate compound (a) and the imino compound (b) are co-used, insufficiency of the image storability with the lapse of time by the former color forming system [(d) and (e)]can be compensated by the color forming system [(a) and (b)]which has excellent image storability. A further characteristic thing is that there is no change in the hue of the colorless dye against light during the image storage by the co-use of the two kinds of color forming systems. For example, when a colorless dye for a black color is used alone, the hue is usually changed from black to blackish brown. In this case, when the color forming system of the aromatic isocyanate compound and the imino compound is co-used, the use of black due to the colorless dye can be maintained without change. As mentioned above, when the two kinds of the color forming systems are co-used, no change of hue advantageously takes place. In addition, when an electron donative colorless dye is used, the image after color formed disappears due to an plasticizer. But when the two kinds of color forming systems are co-used, such an image can be retained.

On the other hand, the thermal transfer layer requires the substance (c) having a low melting point as an essential component which contributes to the transfer properties. The low melting point substance has two functions, that is, a sensitizing function for color formation in one or two color forming systems, and a transfer function of the color forming substances to the plain paper. In each function, the more effective results are obtained when the low melting point substance is used in a larger amount. But when the amount is too much, there arises another defect that the background fogging takes place at the time of coating or drying step or during storage of the product due to the sensitizing function.

The amount of the low melting point substance is preferably 10 to 75 parts by weight, more preferably 20 to 50 parts by weight, based on 100 parts by weight of the total weight of thermal transfer layer. When the amount is less than 10 parts by weight, there is a tendency to become insufficient in the transfer to the plain paper. On the other hand, when the amount is larger than 75 parts by weight, there is a tendency to bring about the background fogging.

In the color forming systems, the use of 3 to 10 parts by weight of the electron donative colorless dye and 5 to 30 parts by weight of the electron-accepting compound is preferable. Further, the use of 5 to 25 parts by weight of the aromatic isocyanate compound and 5 to 25 parts by weight of the imino compound is preferable.

When two kinds of the color forming systems are co-used, it is preferable to use (a) the aromatic isocyanate compound in an amount of 5 to 25 parts by weight, (b) the imino compound in an amount of 5 to 25 parts by weight, (c) the low melting point substance in an amount of 10 to 75 parts by weight, (d) the electron donative colorless dye in an amount of 3 to 10 parts by weight, and (e) the electron-accepting compound in an amount of 5 to 30 parts by weight based on 100 parts by weight of the total amount of the thermal transfer layer.

In the heat-sensitive thermal transfer recording sheet of this invention, the heat-sensitive color-forming layer may contain the above-mentioned one or two kinds of color forming systems. Further, in both of the heatsensitive color-forming layer and the thermal transfer layer, various color forming systems such as the color forming system of an electron donative colorless dye and an electron-accepting compound, the color forming system obtained by a chelate reaction, and the like can be co-used.

Individual components (a) to (e) are explained in detail below.

The isocyanate compounds of the component (a) include aromatic isocyanate compounds and aromatic heterocyclic isocyanate compounds. Examples of these isocyanate compounds are as follows:

Monoisocyanates (i) Phenyl isocyanates which may have substituents:

Phenyl isocyanate, o-chlorophenyl isocyanate, 3,4-dichlorophenyl isocyanate, p-bromophenyl isocyanate, p-nitrophenyl isocyanate, o-methylphenyl isocyanate, p-methoxyphenyl isocyanate, 2,4,6-trichlorophenyl isocyanate, 2,6-dichloro-4-nitrophenyl isocyanate, 2-methyl-4-nitrophenyl isocyanate, 2,5-dimethoxy-4-nitrophenyl isocyanate, 4-nitro-2-bromo-6-cyanophenyl isocyanate, p-trifluoromethylphenyl isocyanate, p-dimethylaminophenyl isocyanate, etc.

(ii) Diphenyl isocyanates which may have substituents:

4-N-phenylcarbamoylphenyl isocyanate, 4'-chloro-4-isocyanate diphenyl ether, diphenylsulfone-2-isocyanate, p-isocyanate benzene, etc.

Diisocyanates (iii) Phenylene diisocyanates which may have substituents:

p-phenylene diisocyanate, m-phenylene diioscyanate, 2,4-tolylene diisocyanate, 2,6-tolylene diisocyanate, 2,5-tolylene diisocyanate, 2-nitrobenzene-1,4-diisocyanate, chlorobenzene-3,5-diisocyanate, 2,5-dimethylbenzene-1,4-diisocyanate, 2-methoxybenzene-1,4-diisocyanate, 2,5-dimethoxybenzene-1,4-diisocyanate, 2,5-diethoxybenzene-1,4-diisocyanate, 2,5-dibutoxybenzene-1,4-diisocyanate, 2-chloro-5-methoxybenzene-1,4-diisocyanate, 2-chloro-5-ethoxybenzene-1,4-diisocyanate, 2,5-diethoxybenzene-1,4-diisocyanate, etc.

(iv) Diphenyl diisocyanates which may have substituents:

4,4-diphenyl diisocyanate, 3,3'-dichloro-4,4'-diphenyl diisocyanate, 3,3'-dimethyl-4,4'-diphenyl diisocyanate, 3,3'-dimethoxy-4,4'-diphenyl diisocyanate, 3,3'-dinitro-4,4'-diphenyl diisocyanate, 3-nitro-4,4'-diphenyl diisocyanate, 3,3'-diethoxy-4,4'-diphenyl diisocyanate, 4,4'-diphenylmethane diisocyanate, 4,4'-diphenylether diisocyanate, diphenylsulfide-4,4'-diisocyanate, diphenylsulfone-4,4'-diisocyanate, 4,4'-diisocyanatediphenylamine, 4,4'-benzophenone diisocyanate, 4,4'-azobenzene diisocyanate, 4,4'-stilbene diisocyanate, 3,3'-dimethyl-4,4'-diphenylmethane diisocyanate, 4,4'-dimethyl-3,3'-diisocyanate diphenylurea, 2-methyl-4,4'-azobenzene diisocyanate, 2-methoxy-4,4'-azobenzene diisocyanate, 2,5-dimethyl-4,4'-azobenzene diisocyanate, 3-methyl-2'-methoxy-azobenzene-4,4'-diisocyanate, 3-chloro-2'-methyl-azobenzene-4,4-diisocyanate, 2-chloroazobenzene-4,3'-diisocyanate, 2-methylazobenzene-4,3'-diisocyanate, 2-methoxyazobenzene-4,3'-diisocyanate, 2,4-azobenzene diisocyanate, 5-methoxyazobenzene-2,4-diisocyanate, 3,3',5',5'-tetramethyldiphenylmethane-4,4'-diisocyanate, etc.

(v) Other isocyanates:

2,8-dibenzothiophene diisocyanate, 3,7-dibenzofuran diisocyanate, 2,7-fluorenone diisocyanate, 2,7-carbazole diisocyanate, dibenzothiophene-3,7-diisocyanate, 2,7-fluorene diisocyanate, 2,7-acridine diisocyanate, 2,7-acridone diisocyanate, 3,6-anthrone diisocyanate, 1,4-naphthalene diisocyanate, 1,5-anthraquinone diisocyanate, 1,4-anthraquinone diisocyanate, 3,8-pyrene diisocyanate, 3,10-perylene diisocyanate, 2,8-diphenyleneoxide diisocyanate, 5,8-quinoline diisocyanate, 2,8-chysene diisocyanate, 4,7-benzoimidazole isocyanate, 2,6-pyridine diisocyanate, 2,5-pyridine diisocyanate, triphenylmethane triisocyanate, 4,4',4''-triisocyanate-2,5-dimethoxytriphenylamine, tris(4-phenyl isocyanate)thiophosphate, polymethylenepolyphenyl isocyanate, etc.

These isocyanates can be used, if necessary, in the form of so-called block isocyanates which are adducts with phenols, lactams, oximes, or the like. Further, these isocyanates can be used in the form of isocyanaurates which are trimers of diisocyanates, e.g. tolylene diisocyanate; polyisocyanates adducted with various polyols, e.g. an adduct of tolylene diisocyanate and trimethylolpropane.

The imino compound used as the component (b) is represented by the formula:

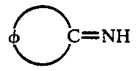

which can form a color by reacting with the above-mentioned isocyanate. Examples of the imino compound are as follows:

3-iminoisoindolin-1-one, 3-imino-4,5,6,7-tetrachloroisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindolin-1-one, 3-imino-6-nitroisoindolin-1-one, 3-imino-isoindolin-1-spiro-dioxolane, 1,1-dimethoxy-3-imino-isoindoline, 1,1-diethoxy-3-imino-4,5,6,7-tetrachloroisoindoline, 1-ethoxy-3-iminoisoindoline, 1,3-diiminoisoindolinone, 1,3-diimino-4,5,6,7-tetrachloroisoindoline, 1,3-diimino-6-methoxyisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo(3,4b)pyrazine, 7-amino-2,3-diphenyl-5-oxopyrrolo(3,4b)pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorphenylimino)-3-iminoisoindoline, 1-(2',4',5'-trichlorophenylimino)-3-iminosoindoline, 1-(2'-cyano-4'-nitrophenylimino)3-iminoisoindoline, 1-(2'-chloro-5'-cyanophenylimino)3-iminoisoindoline, 1-(2',6'-dichloro-4'-nitrophenylimino)-3-iminoisoindoline, 1-(2',5'-dimethoxyphenylimino)3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxy-phenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzoimidazolone-6'-imino)-3-iminoisoindoline, 1-(1'-methylbenzoimidazolone-6'-imino)-3-iminoisoindoline, 1-(7'-chlorobenzoimidazolone-5'-imino)-3-iminoisoindoline, 1-(benzoimidazolyl-2'-imino)-3-iminoisoindoline, 1-(benzoimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzoimidazolyl-2'-imino)-3-imino-4,7-dithiatetrahydroisoindoline, 1-(4',5'-dicyanoimidazolyl-2'-imino)-3-imino-5,6-dimethyl-4,7-pyrazinoisoindoline, 1-(cyanobenzoylmethylene)-3-iminoisoindoline, 1-(cyanocarbonamidemethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2,4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino4,5,6,7-tetrachloroisoindoline, 1-[cyanobenzimidazolyl-2'-methylene]-3-imino-5-methoxyisoindoline, 1-[(cyanobenzimidazolyl-2')-methylene]-3-imino-6-chloroisoindoline, 1-[(1'-phenyl-3'-methyl-5'-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyraziisoindoline, 1-[(1-methyl-3-n-butyl)-barbituric acid-5]-3-iminoisoindoline-3-imino-1-sulfobenzoic acid imid 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, 3-imino-2-methyl-4,5,6,7-tetrachloroisoindolin-1-one, etc.

As the low melting point substance of the component (c), there can preferably be used waxes and the like having a melting point of 40° C. to 200° C., more preferably 50° to 150° C. Examples of the low melting point substance are as follows:

Vegetable waxes:

rice wax, Japan wax, candelilla wax, carnauba wax, etc.

Animal waxes:

lanolin, beeswax, shellac wax, etc.

Mineral waxes:

montan wax, etc.

Synthetic waxes:

paraffin wax, microcrystalline wax, oxidized paraffin wax, chlorinated paraffin wax, ricinolic acid amide, lauric acid amide, erucic acid amide, palmitic acid amide, oleic acid amide, 12-hydroxystearic acid amide, distearyl ketone, ethylenebisstearic acid amide, etc.

Metal soaps:

sodium stearate, sodium palmitate, potassium laurate, potassium myristate, calcium stearate, zinc stearate, aluminum stearate, magnesium stearate, lead stearate, barium dibasic stearate, etc.

Higher fatty acids:

palmitic acid, stearic acid, etc.

Higher alcohols:

palmityl alcohol, stearyl alcohol, ceryl alcohol, etc.

Syntheic polyalcohols:

polyethylene glycol, polypropylene glycol, etc.

As the component (d), electron donative colorless dyes, there can be used the following dyes:

Crystal Violet Lactone, Malachite Green Lactone, 3-diethylamino-6-methyl-7-anilinofluoran, 3-diethylamino-7-dibenzylaminofluoran, 3-diethylamino-7-(N-methylanilino)fluoran, 3-diethylamino-7-(N-methyl-para-toluidino)fluoran, 3-diethylamino-7-chlorofluoran, 3-dimethylamino-6-methyl-7-chlorofluoran, 3-morpholino-5,6-benzofluoran, 3-piperidino-6-methyl-7-anilinofluoran, 3-pyrrolidino-6-methyl-7-anilinofluoran, benzo-$\beta$-naphthospiropyran, 1,3,3-trimethyl-6'-chloro-8'-methoxy-indolinobenzospiropyran, 6'-chloro-8'-methoxy-indolino-benzospiropyran, and the like triphenylmethane-phthalide series, fluoran series, spiropyran series dyes.

It is also possible to use phenothiazine series, indolylphthalide series and leucoauramine series dyes.

As the component (e), electron-accepting compounds, there can be used the following compounds:

phenolic compounds such as 4,4'-isopropylidenediphenol (bisphenol A), 4,4'-isopropylidenebis(2-chlorophenol), 4,4'-isopropylidenebis(2-tert-butylphenol), 4,4'-sec-butylidenediphenol, 4,4'-(1-methyl-n-hexylidene)diphenol, 4-tert-butylphenol, ethyl p-hydroxybenzoate, benzyl p-hydroxybenzoate, 4-tert-octylphenol, 4-phenylphenol, 4-hydroxydiphenoxide, methyl 4-hydroxybenzoate, phenyl 4-hydroxybenzoate, 4-hydroxyacetophenone, salicylic anilide, novolak-type phenol resin, $\alpha$-naphthol, $\beta$-naphthol, etc.;

aromatic carboxylic acids such as phthalic anhydride, gallic acid, salicylic acid, etc.

The thermal transfer layer may further contain one or more other additives such as binders, pigments, surface regulating agents, liquid reforming agents, and the like.

Examples of the binders are polyvinyl alcohol, starches, styrene-maleic anhydride copolymer, styrenebutadiene copolymer emulsion, acrylic emulsion, various latexes, etc.

Examples of the pigments are titanium oxide, calcium carbonate, kaolin, aluminum hydroxide, silicon oxide, zinc oxide, talc, etc.

Examples of the surface regulating agents and liquid reforming agents are nonionic, anionic, cationic and amphoteric surface active agents, etc.

As the substrate, it is preferable to use a thin sheet having a thickness of 10 to 30 μm from the viewpoint of transfer properties. Examples of the substrate are papers such as a condenser paper, a glassine paper, a cast-coated paper, a machine glazed paper, etc.; plastic films such as a polyester film, a polyimide film, a polycarbonate film, a polytetrafluoroethylene film, etc.

The thermal transfer layer can be formed on the other side of the substrate having the heat-sensitive color-forming layer on one side by coating an aqueous coating solution on the whole surface of the substrate with a conventional coater such as an air knife coater, a roll coater, or the like; or coating an aqueous solution or a solvent dispersion on the whole or a part of the substrate by printing using a gravure printing machine.

The thus obtained heat-sensitive thermal transfer recording sheet has the heat-sensitive color-forming layer on the front side of substrate and the thermal transfer layer on the back side of substrate, the color-forming portion of the thermal transfer layer containing a color forming system of an aromatic isocyanate compound and the imino compound, and if necessary, with another color forming system of an electron donative colorless dye and an electron-accepting compound. By using such color forming system or systems, it is possible to prepare a heat-sensitive thermal transfer recording sheet with white background and to make transferred images excellent in resistance to light and resistance to plasticizer as well as excellent in image storability. Further, particularly when the two kinds of color forming systems are co-used, the colored hue of the colorless dye can be maintained with the lapse of time.

On the other hand, the heat-sensitive thermal transfer recording system of this invention is characterized by obtained by coating indivdual color forming components separately on a recording sheet and an image receiving sheet to be transferred. Since the color forming components are separated and present independently, the recording sheet and the image receiving sheet do not contact each other after the transfer with heating and separation. As a result, the transferred image on the image receiving sheet can become a remarkably stable image. Thus, the obtained transferred image on the image receiving paper does not disappear even if treated severely (e.g. exposed to light for a long period of time, dipped in various chemicals, etc.).

The recording sheet can be obtained by coating a heat-sensitive color-forming layer on the front side of a substrate and coating a thermal transfer layer on the back side of the substrate. The thermal transfer layer comprises either one of the component (a), the aromatic isocyanate compound, or the component (b), the imino compound of the formula (I) which can form a color by the reaction with the component (a), and if necessary, either one of the component (d), the electron donative colorless dye, or the component (e), the electron-accepting compound, and as an essential component the low melting point substance (c) which contributes to the transfer properties. The low melting point substance has two functions, one of which is to melt transfer the color forming component or components on the recording sheet to the image receiving sheet, wherein the transferred component(s) are melt mixed and reacted with the color forming component(s) present on the image receiving sheet to form a color, and the other of which is a sensitizing function to accelerate the color formation of the color forming components. In either function, the larger amount of the low melting point substance brings about better effects. But, when the amount is too much, the transfer density becomes low due to the dilution function of the low melting point substance. Further, the storing properties are blocked by the low melting point substance.

The amount of the low melting point substance is preferably 10 to 75 parts by weight, more preferably 20 to 50 parts by weight per 100 parts by weight of the total weight of the thermal transfer layer. When the amount is lower than 10 parts by weight, there is a tendency to make the transfer to a plain paper insufficient. On the other hand, when the amount is larger than 75 parts by weight, the above-mentioned disadvantage appears.

The amount of the aromatic isocyanate compound or the imino compound of the formula (I) is preferably 5 to 50 parts by weight, more preferably 10 to 30 parts by weight per 100 parts by weight of the total weight of the thermal transfer layer. The amount of the electron donative colorless dye is preferably 3 to 10 parts by weight, more preferably 5 to 7 parts by weight, and the amount of the electron-accepting compound is preferably 5 to 30 parts by weight, more preferably 10 to 25 parts by weight, if these are co-used, per 100 parts by weight of the total weight of the thermal transfer layer.

The thermal transfer layer may further contain one or more binders, pigments and the like additives.

The heat-sensitive color-forming layer can be formed by coating on the front side of the substrate a coating composition comprising an electron donative colorless dye such as Crystal Violet Lactone, an electron-accepting compound such as a phenolic compound, as disclosed in Japanese Patent Examined Publication No. 45-14039 (U.S. Pat. No. 3,539,375), and if necessary one or more pigments, sensitizers, binders, and the like additives.

On the other hand, on one surface of the image receiving sheet, there is coated a layer comprising one of the color forming components, that is, the imino compound of the formula (I) or the aromatic isocyanate compound not contained in the thermal transfer layer, in an amount of preferably 5 to 25 parts by weight and if necessary one of the color forming components of the other system, that is, the electron-accepting compound preferably in an amount of 5 to 30 parts by weight, or the electron donative colorless dye preferably 3 to 10 parts by weight. In such a case, it is also possible to add one or more low melting point substances (e.g. 0 to 70 parts by weight), binders (e.g., 0 to 50 parts by weight), pigments (e.g., 0 to 70 parts by weight) and the like additives so as to improve the adhesiveness, liquid properties, whiteness and the like to the coating composition for the image receiving sheet. Further, when the major component is the isocyanate compound, it is possible to contain a relatively small amount of an imino compound. The addition of the low melting point substance is particularly preferable to further accelerate the sensitizing function of the color formation.

Preferable combinations of the components (a) through (e) in the recording system are as follows:

| | |
|---|---|
| (1) Heat transfer layer: | |
| Component (a) | 5-25 parts by weight |
| Component (c) | 10-75 parts by weight |
| Image receiving layer: | |
| Component (b) | 5-25 parts by weight |
| (2) Heat transfer layer: | |

-continued

| | |
|---|---|
| Component (b) | 5–25 parts by weight |
| Component (c) | 10–75 parts by weight |
| Image receiving layer: | |
| Component (d) | 5–25 parts by weight |
| (3) Heat transfer layer: | |
| Component (a) | 5–25 parts by weight |
| Component (c) | 10–75 parts by weight |
| Component (d) | 3–10 parts by weight |
| Image receiving layer: | |
| Component (b) | 5–25 parts by weight |
| Component (e) | 5–30 parts by weight |
| (4) Heat transfer layer: | |
| Component (a) | 5–25 parts by weight |
| Component (c) | 10–75 parts by weight |
| Component (e) | 5–30 parts by weight |
| Image receiving layer: | |
| Component (b) | 5–25 parts by weight |
| Component (d) | 3–10 parts by weight |
| (5) Heat transfer layer: | |
| Component (b) | 5–25 parts by weight |
| Component (c) | 10–75 parts by weight |
| Component (d) | 3–10 parts by weight |
| Image receiving layer: | |
| Component (a) | 5–25 parts by weight |
| Component (e) | 5–30 parts by weight |
| (6) Heat transfer layer: | |
| Component (b) | 5–25 parts by weight |
| Component (c) | 10–75 parts by weight |
| Component (e) | 5–30 parts by weight |
| Image receiving layer: | |
| Component (a) | 5–25 parts by weight |
| Component (d) | 3–10 parts by weight |

Among these combinations, the combination (1), the combination (3) are more preferable.

Further, in the heat-sensitive thermal transfer recording system of this invention, the thermal transfer layer on the recording sheet and the surface layer of the image receiving sheet may contain individual components of the color forming system of an electron donative colorless dye and an electron-accepting compound, the color forming system obtained by a chelate reaction, and the like color forming systems, separately or as a mixture thereof.

As to the components (a) to (e), the substrate for the recording sheet, and other additives, all those explained above concerning the heat-sensitive thermal transfer recording sheet can be applied to the recording sheet for the thermal transfer recording system.

As the substrate for the image receiving sheet, there can be used plain paper, coated paper, synthetic paper, synthetic resin films, metal foils, etc.

As to the method for coating the thermal transfer layer on the opposite side of the heat-sensitive color-forming layer on the recording sheet and the method for coating the layer on the surface of the image receiving layer, there can be employed a method for coating an aqueous coating composition on the whole surface of a substrate by using a conventional coater such as an air knife coater, a roll coater, etc., a method for coating an aqueous coating composition or a solvent dispersion on the whole surface or a part of the surface of a substrate by using a flexo printing machine, a gravure printing machine, or the like.

As mentioned above, the heat-sensitive thermal transfer recording system of this invention comprises the heat-sensitive thermal transfer recording sheet having the heat-sensitive color-forming layer on the front side of the substrate and the thermal transfer layer on the back side of the substrate, and separately the image receiving sheet coated with one component of the color forming system capable of reacting with the other component coated on the thermal transfer layer, the major components of the thermal transfer layer being the aromatic isocyanate compound (a) or the imino compound of the formula (I) (b), and if necessary the electron donative colorless dye (d) or the electron-accepting compound (e), and the low melting point substance (c), and the surface layer of the image receiving sheet comprising the imino compound of the formula (I) or the aromatic isocyanate compound, which is one component for forming a color reacting with the other component contained in the thermal transfer layer, and if necessary the electron-accepting compound or the electron donative colorless dye, which is also one component for forming a color reacting with the other component contained in the thermal transfer layer, so that there can be obtained the heat-sensitive thermal transfer recording sheet having a white background and the image receiving sheet having excellent image storability with excellent resistance to light and resistance to plasticizer.

This invention is illustrated by way of the following Examples, in which all parts and percents are by weight unless otherwise specified.

EXAMPLE 1

On a surface treated polyester film having a thickness of 16 μm, a heat-sensitive color-forming layer of about 5 μm was formed by coating a conventional heat-sensitive coating liquid (for forming a black color) with an air knife coater.

The heat-sensitive coating liquid had the following composition. Further, a colorless dye and an electron-accepting compound were dispersed as follows.

Liquid A (Colorless dye dispersion)

3-Diethylamino-6-methyl-7-anilinofluoran in an amount of 150 parts was dispersed in 18 parts of styrene-maleic anhydride copolymer (Malon MS-25 mfd. by Daido Kogyo Co., Ltd.) and 332 parts of water and ball milled for 24 hours.

Liquid B (Electron-accepting compound dispersion)

Bisphenol A in an amount of 150 parts was dispersed in 18 parts of Malon MS-25 and 332 parts of water and ball milled for 24 hours.

Using the above-mentioned Liquids A and B, the heat-sensitive coating liquid was prepared with the following composition (in solid contents):

| | |
|---|---|
| Calcium carbonate | 5.0 parts |
| Liquid A | 2.0 parts |
| Liquid B | 5.0 parts |
| Stearamide | 2.0 parts |
| Polyvinyl alcohol | 3.45 parts |

On the opposite side of the heat-sensitive color-forming layer, a thermal transfer layer was formed by preparing the following coating composition.

Liquid C (Aromatic isocyanate compound dispersion)

2,5-Dimethoxybenzene-1,4-diisocyanate in an amount of 100 parts was dispersed in 50 parts of 10% polyvinyl alcohol and 183 parts of water, and ball milled for 10 hours.

Liquid D (Imino compound dispersion)

1,3-Diimino-4,5,6,7-tetrachloroisoindoline in an amount of 100 parts was dispersed in 50 parts of 10% polyvinyl alcohol and 183 parts of water, and ball milled for 10 hours.

The coating composition for the thermal transfer layer was prepared by using the Liquids C and D and coated on the opposite side of the heat-sensitive color-forming layer with an air knife coater so as to make the coating amount 6 g/m$^2$.

| Coating composition: | |
|---|---|
| Liquid C | 20 parts |
| Liquid D | 20 parts |
| Stearamide | 20 parts |
| Paraffin wax | 40 parts |

The resulting heat-sensitive thermal transfer recording sheet was subjected to the measurement of reflection density of the background of thermal transfer layer using a Macbeth densitometer RD-918 type. Then, the thermal transfer layer of the recording sheet was superimposed on a plain paper (an image receiving sheet for thermal transfer, TTR-PW, a trade name, mfd. by Mitsubishi Paper Mills, Ltd.), and printing was made from the heat-sensitive color-forming layer side using a facsimile tester manufactured by Matsushita Electronic Components Co., Ltd. and a pulse width of 3.0 msec (2.22 mJ). At the same time, the transfer density was also measured by using the Macbeth densitometer.

Further, the transferred image portion was exposed to xenon light for 3 hours by using a fademeter to measure the retention rate of the transfer density after faded. In addition, a plasticizer test was carried out by adhering an adhesive tape (Mending tape Scotch 810, mfd. by Minnesota Mining and Manufacturing Co.) to the transferred image portion and the retention rate of the transfer density after 72 hours was tested.

The results are shown in Table 1.

TABLE 1

| Example No. | Example 1 | Comparative Example 1 |
|---|---|---|
| Background density of thermal transfer layer | 0.07 | 0.45 |
| Transfer density on plain paper surface | 1.14 | 1.30 |
| Retention rate of transfer density after xenon fade irradiation (%) | 99 | 69 |
| Retention rate at plasticizer test (%) | 98 | 73 |

Note
Background density of plain paper was 0.03.

COMPARATIVE EXAMPLE 1

The process of Example 1 was repeated except for using 10 parts of Liquid A and 30 parts of Liquid B in place of Liquid C and Liquid D to give the thermal transfer layer. The resulting recording sheet was evaluated in the same manner as described in Example 1.

The results are shown in Table 1.

EXAMPLES 2 TO 4, COMPARATIVE EXAMPLE 2

The coatings were made in the same manner as described in Example 1 with the compositions as shown in Table 2 and evaluated in the same manner as described in Example 1.

The results are shown in Table 2.

TABLE 2

| Example No. | | Example 2 | Example 3 | Example 4 | Comparative Example 2 |
|---|---|---|---|---|---|
| Formulation of coating liquid (parts) | Liquid A | — | — | — | 5 |
| | Liquid B | — | — | — | 15 |
| | Liquid C | 10 | 10 | 10 | — |
| | Liquid D | 10 | 10 | 10 | — |
| | Paraffin wax | 10 | 30 | 60 | 65 |
| | Stearmide | 30 | 20 | 15 | 15 |
| | Calcium carbonate | 20 | 10 | 5 | — |
| | Polyvinyl alcohol | 20 | 20 | — | — |
| Evaluation | Background density of thermal transfer layer | 0.05 | 0.06 | 0.05 | 0.40 |
| | Transfer density on plain paper surface | 1.06 | 1.12 | 1.10 | 1.24 |
| | Retention rate of transfer density after xenon fade irradiation (%) | 97 | 98 | 96 | 63 |
| | Retention rate at plasticizer test (%) | 96 | 98 | 99 | 8 |

As is clear from Table 2, when Liquid C and Liquid D are used, the background density is low and the retention rate by xenon fade and the retention rate at the plasticizer test are high and excellent.

On the other hand, when Liquid A and Liquid B are used, the background density is high and the retention rate by xenon fade and the retention rate at the plasticizer test are low. Particularly, the retention rate at the plasticizer test is remarkably low.

EXAMPLE 5

A heat-sensitive coating liquid was prepared in the same manner as described in Example 1 and coated on a substrate to form a heat-sensitive color-forming layer.

Further, Liquid C and Liquid D were prepared in the same manner as described in Example 1.

Using the above-mentioned Liquid C and Liquid D as well as Liquid A and Liquid B used for the heat-sensitive liquid, a coating composition for the thermal transfer was prepared as follows and coated on the opposite side of the heat-sensitive color-forming layer so as to make the coating amount 6 g/m$^2$ with an air knife coater:

| | |
|---|---|
| Liquid A | 5 parts |
| Liquid B | 15 parts |
| Liquid C | 10 parts |
| Liquid D | 10 parts |

-continued

| | |
|---|---|
| Stearamide | 20 parts |
| Paraffin wax | 40 parts |

The resulting heat-sensitive thermal transfer recording sheet was subjected to the measurements of reflection density of background of the thermal transfer layer, thermal transfer to plain paper, transfer density, fade of transferred image, retention rate, the plasticizer test in the same manner as described in Example 1.

The results are shown in Table 3.

COMPARATIVE EXAMPLE 3

The process of Example 5 was repeated except for not using Liquid C and Liquid D to form the thermal transfer layer. The resulting recording sheet was evaluated in the same manner as described in Example 5.

The results are shown in Table 3.

TABLE 3

| Example No. | Example 5 | Comparative Example 3 |
|---|---|---|
| Background density of thermal transfer layer | 0.08 | 0.30 |
| Transfer density on plain paper surface | 1.17 | 1.22 |
| Retention rate of transfer density after xenon fade irradiation (%) | 98 | 60 |
| Hue before xenon fade irradiation | Black | Black |
| Hue after xenon fade irradiation | Black | Brown |
| Retention rate at plasticizer test (%) | 90 | 5 |

Note
Background density of plain paper was 0.03.

EXAMPLES 6 TO 8, COMPARATIVE EXAMPLE 4

The process of Example 5 was repeated except for using the coating liquids, as shown in Table 4 and the resulting coatings were evaluated in the same manner as described in Example 5.

The results are shown in Table 4.

TABLE 4

| Example No. | | Example 6 | Example 7 | Example 8 | Example 9 |
|---|---|---|---|---|---|
| Formulation of coating liquid (parts) | Liquid A | 5 | 5 | 5 | 2 |
| | Liquid B | 15 | 15 | 10 | 8 |
| | Liquid C | 10 | 10 | 5 | 5 |
| | Liquid D | 10 | 10 | 5 | 5 |
| | Paraffin wax | 10 | 30 | 60 | 65 |
| | Stearamide | 25 | 20 | 15 | 15 |
| | Calcium carbonate | 10 | — | — | — |
| | Polyvinyl alcohol | 15 | 10 | — | — |
| Evaluation | Background density of thermal transfer layer | 0.06 | 0.07 | 0.12 | 0.30 |
| | Transfer density on plain paper surface | 1.01 | 1.14 | 1.08 | 1.22 |
| | Retention rate of transfer density after xenon fade irradiation (%) | 94 | 96 | 90 | 70 |
| | Hue before xenon fade irradiation | Black | Black | Black | Black |
| | Hue after xenon fade irradiation | Black | Black | Black | Brown |
| | Retention rate at plasticizer test (%) | 88 | 90 | 82 | 80 |

In Example 9, since Liquids A through D are coused together with 80 parts of the low melting point substance, the retention rate at plasticizer test is as high as 80%, which value is remarkably higher than 8% of Comparative Example 2 wherein only Liquids A and B are coused together with 80 parts of the low melting point substance. However, in Example 9, since the amount of the low melting point substance is as high as 80 parts, there is an advantage in that the transfer density is high but there is a tendency to undesirably enhance the background density and to undesirably lower the retention rate after xenon fade irradiation. In contrast, in Examples 6 to 8, since the Liquids A through D are coused together with the low melting point substance in an amount of 10 to 75 parts, the resulting properties are excellent in all tested items, particularly in the background density, the retention rate afer xenon fade irradiation and the hue.

EXAMPLE 10

(1) Preparation of heat-sensitive thermal transfer recording sheet

On a surface treated polyester film having a thickness of 16 μm, a conventional heat-sensitive coating liquid (for forming a black color) was coated with an air knife coater so as to give a heat-sensitive color-forming layer of about 5 μm thick.

Liquid A (colorless dye dispersion), Liquid B (electron donative compound dispersion) and the heatsensitive coating liquid were prepared in the same manner as described in Example 1.

On the other hand, a coating composition for a thermal transfer layer with the composition mentioned below was prepared.

Liquid C (Aromatic isocyanate compound dispersion)

2,5-Dimethoxybenzene-1,4-diisocyanate in an amount of 100 parts was dispersed in 50 parts of 10% polyvinyl alcohol and 183 parts of water and ball milled.

Using the above-mentioned Liquid C, the coating composition for the thermal transfer layer was prepared and coated on the opposite side of the heat-sensitive color-forming layer with an air knife coater so as to make the coating amount 6 g/m$^2$.

| Coating composition: | |
|---|---|
| Liquid C | 25 parts |
| Stearamide | 25 parts |
| Paraffin wax | 50 parts |

(2) Preparation of image receiving sheet

A coating composition for the surface of an image receiving sheet was prepared as follows.

Liquid D (Imino compound dispersion)

1,3-Diimino-4,5,6,7-tetrachloroisoindoline in an amount of 100 parts was dispersed in 50 parts of 10% polyvinyl alcohol and 183 parts of water and ball milled.

Using the above-mentioned Liquid D, the coating composition for the surface layer of the image receiving paper was prepared and coated with an air knife coater so as to make the coating amount 3.5 g/m$^2$.

| Coating composition: | |
|---|---|
| Liquid D | 40 parts |
| Stearamide | 20 parts |
| Calcium carbonate | 20 parts |
| Polyvinyl alcohol | 20 parts |

The properties were tested in the same manner as described in Example 1.

The results are shown in Table 5.

COMPARATIVE EXAMPLE 4

The process of Example 10 was repeated except for using Liquid A in place of Liquid C for the recording sheet and using Liquid B in place of Liquid D for the image recieving sheet. The evaluations were conducted in the same manner as described in Example 10.

The results are shown in Table 5.

TABLE 5

| Example No. | Example 10 | Comparative Example 4 |
|---|---|---|
| Background density of thermal transfer layer | 0.04 | 0.05 |
| Background density of surface layer of image receiving sheet | 0.04 | 0.04 |
| Transfer density on image receiving sheet | 1.20 | 1.35 |
| Retention rate of transfer density after xenon fade irradiation (%) | 99 | 54 |
| Retention rate at plasticizer test (%) | 98 | 15 |

EXAMPLES 11 to 13

The process of Example 10 was repeated except for using the coating composition as listed in Table 6 for preparing the recording sheets. The same image receiving sheets as obtained in Example 10 (2) were used. The resulting heat-sensitive thermal transfer recording systems were evaluated in the same manner as described in Example 16.

The results are shown in Table 6.

TABLE 6

| Example No. | | 11 | 12 | 13 |
|---|---|---|---|---|
| Formulation of coating composition (parts) | Liquid C | 30 | 20 | 10 |
| | Paraffin wax | 10 | 30 | 60 |
| | Stearamide | 20 | 20 | 15 |
| | Calcium carbonate | 20 | 10 | 5 |
| | Polyvinyl alcohol | 20 | 20 | — |
| Evaluation | Background density of thermal transfer layer | 0.04 | 0.05 | 0.04 |
| | Transfer density on image receiving sheet | 1.15 | 1.10 | 1.05 |
| | Retention rate of transfer density after xenon fade irradiation (%) | 98 | 96 | 95 |
| | Retention rate at plasticizer test (%) | 98 | 96 | 97 |

As is clear from Table 6, the heat-sensitive thermal transfer recording systems of this invention are low in the background density, and high in the retention rates after xenon fade irradiation and at the plasticizer test.

What is claimed is:

1. In a heat-sensitive thermal transfer recording sheet comprising a substrate, a heat-sensitive color-forming layer formed on a front side of said substrate and a thermal transfer layer formed on a back side of the substrate, the improvement wherein the thermal transfer layer comprises:

(a) an aromatic isocyanate compound, (b) an imino compound of the formula:

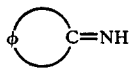

(I)

wherein is an aromatic compound residue which can form a conjugated system with an adjacent C=N and which can form a color by a reaction with said isocyanate compound, and (c) a substance having a low melting point, whereby the desired images are thermally transferred to an image receiving sheet.

2. A heat-sensitive thermal transfer recording sheet according to claim 1, wherein the thermal transfer layer further comprises (d) an electron donating colorless dye, and (e) an electron-accepting compound.

3. A heat-sensitive thermal transfer recording sheet according to claim 2, wherein the thermal transfer layer comprises 5 to 25 parts by weight of the aromatic isocyanate compound, 5 to 25 parts by weight of the imino compound, 10 to 75 parts by weight of the low melting point substance, 3 to 10 parts by weight of the electron donative colorless dye, and 5 to 30 parts by weight of the electron-accepting compound, the total being 100 parts by weight.

4. A heat-sensitive thermal transfer recording sheet according to claim 1, wherein the thermal transfer layer comprises 5 to 25 parts by weight of the aromatic isocyanate compound, 5 to 25 parts by weight of the imino compound and 10 to 75 parts by weight of the low melting point substance, the total being 100 parts by weight.

5. A heat sensitive thermal transfer recording sheet according to claim 1, wherein the substrate has a thickness of 10 to 30 μm.

6. A heat-sensitive thermal transfer recording system according to claim 5, wherein the thermal transfer layer of the recording sheet (A) further comprises (d) an electron donating colorless dye, and (e) an electron-accepting compound.

7. A heat-sensitive thermal transfer recording system according to claim 5, wherein the substrate of the recording sheet (A) has a thickness of 10 to 30 μm.

8. A heat-sensitive thermal transfer recording system according to claim 5, wherein the image receiving sheet (B) is plain paper.

9. In a heat-sensitive thermal transfer recording system comprising (A) a heat-sensitive thermal transfer recording sheet comprising a substrate, a heat-sensitive color-forming layer formed on a front side of said substrate, and a thermal transfer layer formed on a back side of the substrate, and (B) an image receiving sheet, the improvement wherein the thermal transfer layer of the recording sheet (A) comprises:

(a) an aromatic isocyanate compound, or (b) an imino compound of the formula:

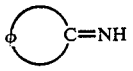

(I)

wherein ϕ is an aromatic compound residue which can form a conjugated system with an adjacent C=N and which can form a color by a reaction with said isocyanate compound, and (c) a substance having a low melting point, and the surface layer of the image receiving sheet (B) to be superimposed on said recording sheet comprises:

(b) an imino compound of the formula (I), or (a) an aromatic isocyanate compound, which is one component of the color forming components and reacts with the other component (a) or (b) in the thermal transfer layer.

10. A heat-sensitive thermal transfer recording system according to claim 9, wherein the thermal transfer layer of the recording sheet further comprises (d) an electron donative colorless dye, or (e) an electron-accepting compound, and the surface layer of the image receiving sheet further comprises (e) an electron-accepting compound or (d) an electron donative colorless dye, which is one component of the color forming components of another system and reacts with the other component (d) or (e) in the thermal transfer layer.

11. A heat-sensitive thermal transfer recording system according to claim 10, wherein the thermal transfer layer of the recording sheet comprises 5 to 25 parts by weight of the aromatic isocyanate compound or the imino compound, 10 to 75 parts by weight of the low melting point substance, and 3 to 10 parts by weight of the electron donative colorless dye or 5 to 30 parts by weight of the electron-accepting compound, and the surface layer of the image receiving sheet comprises 5 to 25 parts by weight of the imino compound or the aromatic isocyanate compound and 5 to 30 parts by weight of the electron-accepting compound or 3 to 10 parts by weight of the electron donative colorless dye.

12. A heat-sensitive thermal transfer recording system according to claim 9, wherein the thermal transfer layer of the recording sheet comprises 5 to 25 parts by weight of the aromatic isocyanate compound or the imino compound and 10 to 75 parts by weight of the low melting point substance, and the surface layer of the image receiving sheet comprises 5 to 25 parts by weight of the imino compound or the aromatic isocyanate compound.

13. In a heat-sensitive thermal transfer recording system comprising (A) a heat-sensitive thermal transfer recording sheet comprising a substrate, a heat-sensitive color-forming layer formed on a front side of said substrate, and a thermal transfer layer formed on a back side of substrate, and (B) an image receiving sheet, the improvement wherein the thermal transfer layer of the recording sheet (A) comprises:

(a) an aromatic isocyanate compound, (b) an imino compound of the formula:

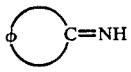

(I)

wherein is an aromatic compound residue which can form a conjugated system with an adjacent C–N and which can form a color by a reaction with said isocyanate compound, and (c) a substance having a low melting point.

* * * * *